US007221894B2

(12) United States Patent
Kishi

(10) Patent No.: US 7,221,894 B2
(45) Date of Patent: May 22, 2007

(54) IMAGE FORMING APPARATUS WHICH PREVENTS MISREGISTRATION

(75) Inventor: Takehiro Kishi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 292 days.

(21) Appl. No.: 11/081,553

(22) Filed: Mar. 17, 2005

(65) Prior Publication Data

US 2005/0214037 A1 Sep. 29, 2005

(30) Foreign Application Priority Data

Mar. 26, 2004 (JP) ..... 2004-092412

(51) Int. Cl.
*G03G 15/01* (2006.01)

(52) U.S. Cl. ..... 399/302; 399/299; 399/300; 399/301; 399/306; 399/308

(58) Field of Classification Search ..... 399/299, 399/300, 301, 302, 306, 308
See application file for complete search history.

(56) References Cited

U.S. PATENT DOCUMENTS

| | | | | |
|---|---|---|---|---|
| 5,960,241 | A | 9/1999 | Yoshida | 399/299 |
| 6,185,402 | B1 * | 2/2001 | Linssen | 399/301 |
| 6,314,264 | B1 * | 11/2001 | Iida et al. | 399/302 |
| 6,330,404 | B1 | 12/2001 | Munenaka et al. | 399/51 |
| 2002/0053393 | A1 | 5/2002 | Yamaguchi et al. | 156/218 |
| 2003/0108366 | A1 * | 6/2003 | Yamada et al. | 399/299 |
| 2004/0184828 | A1 * | 9/2004 | Bannai et al. | 399/301 |

FOREIGN PATENT DOCUMENTS

| | | |
|---|---|---|
| EP | 1 020 774 A2 | 7/2000 |
| EP | 1 031 887 A2 | 8/2000 |
| EP | 1 324 148 A1 | 7/2003 |
| JP | 64-31173 | 2/1989 |
| JP | 6-161205 | 6/1994 |
| JP | 9-179374 | 7/1997 |
| JP | 2000-19810 | 1/2000 |
| JP | 2000-356875 | 12/2000 |
| JP | 2002-137300 | 5/2002 |
| JP | 2003-66736 | 3/2003 |

* cited by examiner

OTHER PUBLICATIONS

Patent Absracts of Japan, Publication No. 01031173, Feb. 1, 1989.

*Primary Examiner*—David M. Gray
*Assistant Examiner*—Ryan D. Walsh
(74) *Attorney, Agent, or Firm*—Fitzpatrick, Cella, Harper & Scinto

(57) ABSTRACT

To provide an image forming apparatus including a first image bearing member, first toner image forming means which forms a first toner image on the first image bearing member, an intermediate transfer member in which a circumferential face is formed, the circumferential face rotates in a predetermined direction by using the center of the circumferential face as a rotating center and the thickness is periodically changed at a predetermined interval in the predetermined rotating direction, a first primary transfer region in which the first toner image on the first image bearing member is transferred to the intermediate transfer member, a second image bearing member and a second primary transfer region in which the toner image on the second image bearing member is transferred to the intermediate transfer member to which the first toner image is transferred, in which the distance between the central position of the first primary transfer region and the central position of the second primary transfer region in the rotating direction of the intermediate transfer member is approximately integer times of the predetermined interval. Thereby, it is possible to restrain misregistration from occurring.

18 Claims, 9 Drawing Sheets

IMAGE FORMING APPARATUS WHICH PREVENTS MISREGISTRATION

BACKGROUND OF THE INVENTION

1. Field of the Invention

The present invention relates to an image forming apparatus for preventing misregistration from occurring due to a change of thicknesses of an intermediate transferring member in a color image forming apparatus using the intermediate transferring member whose thicknesses are periodically varied, a recording material bearing member and an electrostatic image bearing member.

2. Related Background Art

In the case of an image forming apparatus using the electrophotography, a color image forming apparatus capable of forming a color image has been popular with users.

In the case of an electrophotographic color image forming apparatus, the following systems are used: a system for superimposing a plurality of toner images on an intermediate transferring member, a system for superimposing a plurality of toner images on a recording material born by a recording material bearing member and a system for superimposing a plurality of toner images on an electrostatic image bearing member. Moreover, belt-shaped intermediate transferring member, recording material bearing member and electrostatic image bearing member are widely used because they have a high versatility of arrangement in an image forming apparatus.

Furthermore, the belt-shaped intermediate transferring member, recording material bearing member and electrostatic image bearing member are frequently manufactured in accordance with a centrifugal molding method or a manufacturing method including a step of being rolled by a roller-shaped member because they have a high manufacturing convenience.

However, when using the belt-shaped intermediate transferring member, recording material bearing member or electrostatic image bearing member, a toner image is not formed on a desired position of the intermediate transferring member, recording material born by a recording member or electrostatic image bearing member manufactured by the above-described method and a problem occurs that the so-called misregistration occurs because a relative position of each toner image follows a desired position.

SUMMARY OF THE INVENTION

It is an object of the present invention to provide an image forming apparatus capable of preventing misregistration from occurring in an image forming apparatus in which toner images are superimposed on an intermediate transferring member, recording material born by a recording material bearing member or electrostatic image bearing member.

It is another object of the present invention to provide an image forming apparatus comprising a first image bearing member; first toner image forming means, which forms a first toner image on the first image bearing member; an intermediate transferring member in which a circumferential face is formed, the circumferential face rotates in a predetermined direction by using the center of the circumferential face as a rotating center and the thicknesses are periodically changed at a predetermined interval in the predetermined rotating direction; a first primary transfer region in which the first toner image on the first image bearing member is transferred to the intermediate transferring member; a second image bearing member; second toner image forming means which forms a second toner image on the second image bearing member and a second primary transfer region in which the toner image on the second image bearing member is transferred to the intermediate transferring member to which the first toner image is transferred, wherein the distance between the central position of the first primary transfer region and the central position of the second primary transfer region in the rotating direction of the intermediate transferring member is approximately integer multiples of the predetermined interval.

It is another object of the present invention to provide an image forming apparatus comprising a first image bearing member, first toner image forming means, which forms a first toner image on the first image bearing member, a recording material bearing member in which a circumferential face is formed, the circumferential face rotates in a predetermined direction by using the center of the circumferential face as a rotating center, the thicknesses are periodically changed at a predetermined interval in the predetermined rotating direction and a recording member is born and conveyed, a first transfer region in which the first toner image on the first image bearing member is transferred to the recording material borne and conveyed by the recording material bearing member, a second image bearing member, second toner image forming means which forms a second toner image on the second image bearing member and second transfer region in which the toner image on the second image bearing member is transferred to the recording material borne and conveyed by the recording material bearing member to which the first toner image is transferred, wherein the distance between the central position of the first transfer region in the rotating direction of the recording material bearing member and the central position of the second transfer region is approximately integer multiples of the predetermined interval.

It is still another object of the present invention to provide an image forming apparatus comprising an electrostatic image bearing member in which a circumferential face is formed, the circumferential face rotates in a-predetermined direction by using the center of the circumferential face as a rotating center and the thicknesses are periodically changed at a predetermined interval in the predetermined rotating direction, first electrostatic image forming means which forms a first electrostatic image on the electrostatic image bearing member in a first forming region and second electrostatic image forming means which forms a second electrostatic image the electrostatic image bearing member in a second forming region, wherein the distance between the central position of the first region and the central position of the second region in the rotating direction of the electrostatic image bearing member is approximately integer multiples of the predetermined interval.

DESCRIPTION OF THE PREFERRED EMBODIMENTS

According to the study by the present inventor, periodic thickness unevenness occurs in the intermediate transferring member in the manufacturing steps of the intermediate transferring member, recording material bearing member and electrostatic image bearing member.

Moreover, the running speed of the intermediate transferring member is periodically changed due to the periodic thickness unevenness. The periodic speed change is a cause of misregistration.

Therefore, in the case of the present invention, the above problem is solved by setting the distance between primary transfer portions in which a toner image on an image bearing member is transferred to an intermediate transferring member, the distance between transfer portions in which a toner image on an image bearing member is transferred to a recording material borne by and conveyed to a recording material bearing member and the distance between forming regions in which an electrostatic image is formed on an electrostatic image bearing member to approximately integer multiples of a periodic interval (distance) of thickness unevenness of the intermediate transferring member.

That is, according to the above action, displacements of the position of an actually transferred toner image and a desired position become almost the same in a primary transfer portion and a transfer portion on an intermediate transferring member and a recording material borne by and conveyed to a recording material bearing member. Similarly, displacements of the position of an actually formed electrostatic image and a desired position become almost the same in forming regions on an electrostatic image bearing member. Thus, the problem that misregistration occurs is solved.

Embodiments of the present invention are described below in detail.

An image forming apparatus according to the present invention is described more particularly along the drawings.

<Embodiment 1>

[General Configuration and Operations of Image forming apparatus]

Figure 1:
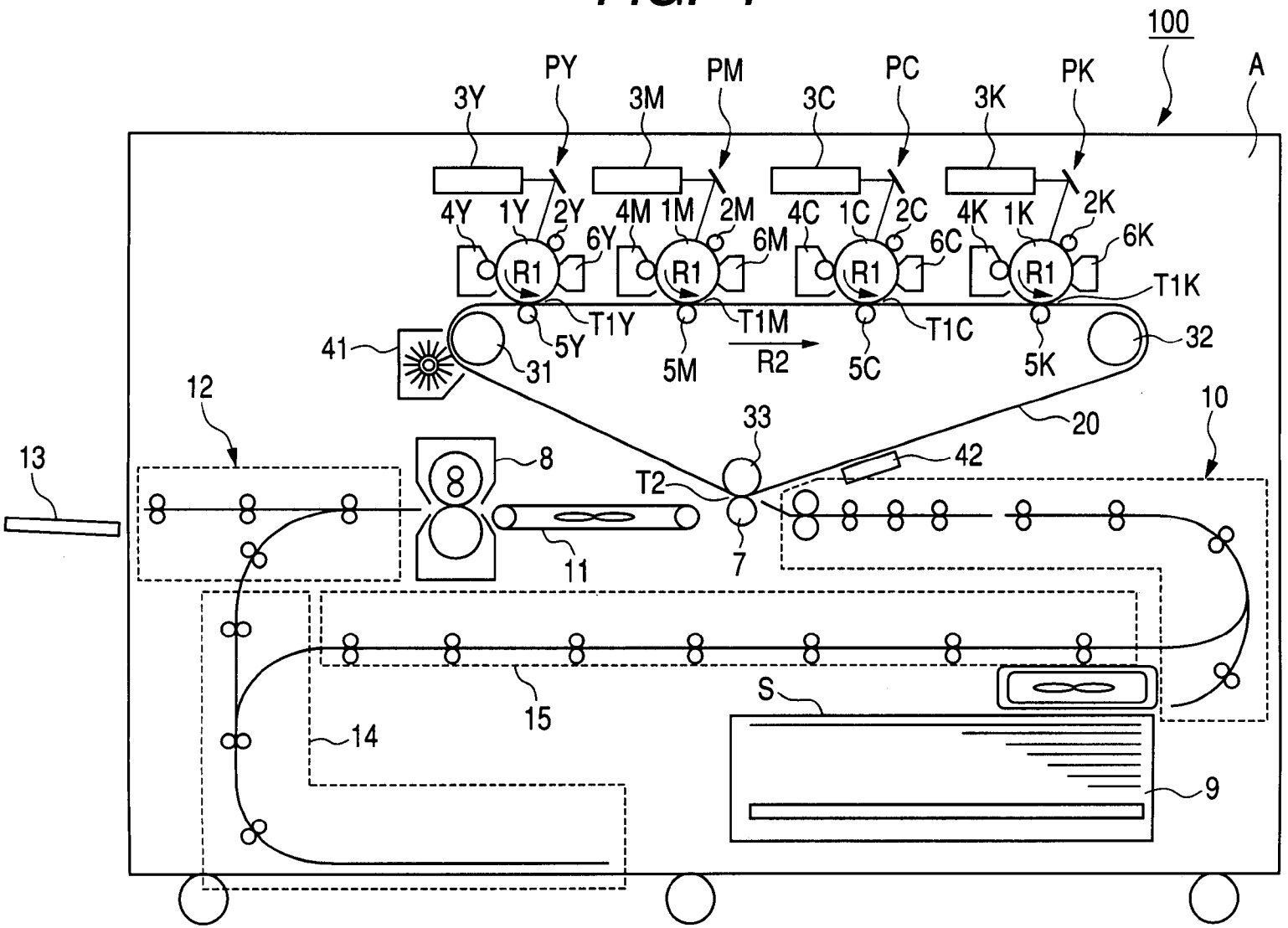
FIG. 1 is a schematic sectional view showing the general configuration of an embodiment of an image forming apparatus of the present invention.

First, a general configuration and operations of an embodiment of an image forming apparatus of the present invention are described below by referring to FIG. 1. FIG. 1 shows a general configuration of the image forming apparatus 100 of this embodiment.

The image forming apparatus 100 of this embodiment is a color laser beam printer capable of forming a full color image of four colors by using an electrophotographic system for a recording member such as a recording sheet, OHP sheet or cloth in accordance with an image information signal supplied from an external unit such as a personal computer communicably connected to the main body of an image forming apparatus (hereafter referred to as apparatus main body) or a manuscript reader for optically reading manuscript image information and converting the image into an electrical signal.

As shown in FIG. 1, the image forming apparatus 100 has four image forming stations (first to fourth image forming stations) PY, PM, PC and PK as image forming portions respectively capable of forming an image. In the case of this embodiment, configurations and operations of the four image forming stations PY, PM, PC and PK of the image forming apparatus 100 are substantially the same except that colors of toner images to be formed are different. Therefore, in the case without requiring a particular distinction the configurations and operations are described in the block so as to show a factor belonging to any station by omitting suffixes Y, M, C and K provided for symbols in FIG. 1.

A cylindrical photosensitive member (hereafter referred to as photosensitive drum) 1 rotating in the direction of the arrow R1 in FIG. 1 is set to the image forming station P as a dedicated image bearing member. Dedicated charging means 3, developing means 4, primary transfer means 5 and photosensitive member cleaning means 6 are set around each photosensitive drum 1 along its rotating direction.

Figure 2:
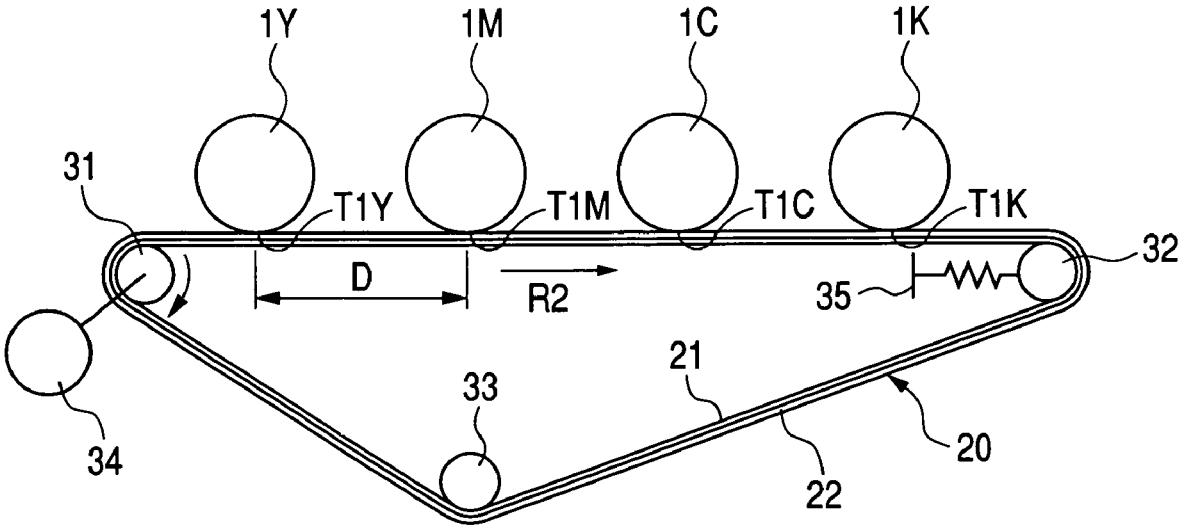
FIG. 2 is an enlarged schematic view of the circumference of an intermediate transfer belt of the image forming apparatus in FIG. 1.

An intermediate transfer belt 20 serving as an endless belt member is set as an intermediate transferring member below each photosensitive drum 1 so as to horizontally penetrate each image forming station P. In the case of this embodiment, the intermediate transfer belt 20 receives images by a plurality of image forming positions corresponding to each of a plurality of image forming stations PY, PM, PC and PK (primary transfer portions T1Y, T1M, T1C and T1K to be described later) and constitutes an image conveying member for conveying the images. Though details will be described later, the intermediate transfer belt 20 is applied to a plurality of rollers and rotated in the direction of the arrow R2 in FIG. 1 when driving is input to the driving roller 31 which is one of the rollers from a driving source 34 (FIG. 2). A registration detection sensor 42, secondary transfer means 7 and intermediate transferring member cleaning means 41 are set around the intermediate transfer belt 20 along the rotating direction of the belt 20.

For example, to form a full-color image of four colors, the image forming apparatus 100 operates as described below.

First, the apparatus 100 forms a yellow toner image (first toner image) on a photosensitive drum 1Y (first image bearing member) of the first image forming station PY by known electrophotographic image forming process. That is, the surface of the rotating photosensitive drum 1Y of the first image forming station PY is uniformly charged by a charging roller 2Y as charging means to which a predetermined charging bias is applied. Then, a latent image (electrostatic image) having yellow component color of a manuscript image is formed on the photosensitive drum 1Y by scanning and exposing the surface of the uniformly-charged photosensitive drum 1Y by a laser scanner system 3Y serving as exposing means. Thereafter, by supplying a developer having a yellow dry developer powder (toner) from a developing machine 4Y (first toner image forming means) in accordance with the latent image as developing means, the latent image on the photosensitive drum 1Y is visualized and imaged as a yellow toner image. The yellow toner image is transferred (primary transfer) to the intermediate transfer belt 20 in accordance with the action of a predetermined primary transfer bias applied to a primary transfer roller 5Y in the primary transfer portion T1Y (first primary transfer region) in which the primary transfer roller 5Y serving as primary transfer means is faced with the photosensitive drum 1Y through the intermediate transfer belt 20.

When the yellow toner image on the photosensitive drum 1Y is primary-transferred to the intermediate transfer belt 20, the intermediate transfer belt 20 contacts with the photosensitive drum 1Y at the primary transfer portion T1Y.

While the yellow toner image is transferred to the intermediate transfer belt 20, a magenta toner image is formed on a photosensitive drum 1M similarly to the case of the yellow toner image on the second image forming station PM.

That is, the surface of the rotating photosensitive drum 1M (second image bearing member) of the second image forming station PM is uniformly charged by a charging roller 2M as charging means to which a predetermined charging bias is applied. Then, by scanning and exposing the surface of the uniformly-charged photosensitive drum 1M by the laser scanner system 3M serving as exposure means, a latent image (electrostatic image) of magenta component color of manuscript image is formed on the photosensitive drum 1M. Thereafter, by supplying a developer having dry developer powder of magenta (toner) from a developing machine 4M (second toner image forming means) in accordance with the latent image as developing means, the latent image on the photosensitive drum 1M is visualized and imaged as a magenta toner image (second toner image).

Then, when the intermediate transfer belt 20 to which the yellow toner image is transferred by the first image forming station PY moves to the primary transfer portion T1M (second primary transfer region) of the second image forming station PM, the magenta toner image is transferred to a predetermined position on the intermediate transfer belt 20 to which the yellow toner image is transferred.

When the magenta toner image on the photosensitive drum 1M is transferred to the intermediate transfer belt 20, the intermediate transfer belt 20 contacts with the photosensitive drum 1M on the primary transfer portion T1M.

A cyan toner image and black toner image are primary-transferred to the intermediate transfer belt 20 similarly to the above mentioned in the primary transfer portions (third and fourth image forming positions) of cyan color and black color T1C and T1M. Thus, when superimposition of toner images of four colors on the intermediate transfer belt 20 is completed, the-intermediate transfer belt 20 further moves and the toner images are transferred to a recording material S in accordance with the action of a predetermine secondary transfer bias applied to a secondary transfer roller 7 at a secondary transfer portion T2 where the secondary transfer roller 7 faces the intermediate belt 20 as a secondary means.

The recording material S is discharged from a recording-material storing portion 9 and sent to the secondary transfer portion T2 by a recording-material supply portion 10 having a conveying roller and a registration roller so as to synchronize with the timing reaching the secondary transfer portion T2 after formation of toner images of four colors on the intermediate transfer belt 20 is completed.

The recording material S to which toner images of four colors are transferred at the secondary transfer portion T2 is separated from the intermediate transfer belt 20, conveyed on a conveying belt 11 and conveyed to a heating, pressurizing and fixing system 8 serving as fixing means set to the downstream side of the conveying belt 11. An unfixed toner image on the recording material S is heated and pressurized in the system 8 to fix on the recording materials S and thereby, a full-color image is obtained on the recording material S.

Thereafter, the recording material S is ejected to a tray 13 set to the outside of the system through a recording material discharge portion 12 having a discharge roller and the like.

The remaining toner remaining on each photosensitive drum 1 passing through a primary transfer step is removed by photosensitive cleaning means 6 having a blade contacting with the photosensitive drum 1 as a cleaning member to prepare for formation of the next latent image which will be continuously performed. Moreover, the remaining toner remaining on intermediate transfer belt 20 passing through the secondary transfer step is removed by intermediate transfer member cleaning means 41 having a brush roller to be rotated by contacting with the intermediate transfer belt 20 as a cleaning member to prepare for the next image formation.

In the case of this embodiment, the photosensitive drum 1, charging roller 2, laser scanner system 3, developing machine 4 and primary transfer roller 5 of each image forming station P constitute image forming means which forms toner images of various colors on the intermediate transfer belt 20.

The image forming apparatus 100 makes it possible to form an image of a single color or optional selected color in accordance with a request. In this case, it is possible to form an image only on an optional single image forming station or a plurality of image forming stations to be required and transfer the image to the recording material S through the intermediate transfer belt 20 similarly to the above described.

Moreover, the image forming apparatus 100 has an inversion route 14 for forming an image on the both sides of the recording material S and a both-side image forming unit 15. To form an image on the both sides of the recording material S, the recording material S forming an image on a first face and discharged from the fixing system 8 is introduced into the inversion route 14 and conveyed to the secondary transfer portion T2 again through the both-side image forming unit 15 after switched back.

[Intermediate Transfer Belt]

Then, by referring to FIG. 2, the intermediate transfer belt 20 used for the image forming apparatus 100 is further described below.

The intermediate transfer belt 20 has a low-elastic resin layer (first layer) 21 and a high-elastic rubber layer (second layer) 22 serving as an elastic layer (elastic member). The high-elastic rubber layer 22 is set to the surface layer (that is, photosensitive drum 1 side). This is used to obtain shape stability and high durability due to the stiffness of the low-elastic resin layer 21 and an advantage for improvement of the transfer efficiency due to the elasticity of the high-elastic rubber layer 22.

As shown in FIG. 2, the intermediate transfer belt 20 is applied to the driving roller 31, a tension roller 32 and a secondary transfer facing roller 33. Moreover, the intermediate transfer belt 20 runs in the direction of the illustrated arrow R2 in accordance with the rotation of the driving roller 31 driven by the driving source 34. The driving roller 31 is set so as to contact with the back face of a face to which the toner image of the intermediate transfer belt 20 is transferred.

Positions of the driving roller 31 and secondary transfer facing roller 33 are fixed to the intermediate transfer belt 20. The tension roller 32 is energized by an elastic member 35 such as a spring and has a function for applying a predetermined tension to the intermediate transfer belt 20.

As described above, the thickness unevenness of the intermediate transfer belt 6 can be listed as a main cause of the speed variation of the intermediate transfer belt 6.

Then, the generation mechanism of misregistration when thickness unevenness is present in the intermediate transfer belt 20 is described below in detail.

In this specification, measurement of the thickness unevenness of a belt member is performed by applying a laser displacement gauge from the vertical direction of a belt face. The laser displacement gauge is adjusted so that a laser beam can be applied to the same position of the surface and back and zero calibration is performed at this position. In this case, it is possible to obtain the difference between measured data values and measure a thickness. By performing the measurement while rotating the belt member, it is possible to measure the thickness unevenness in the circumferential direction of the belt member.

Figure 3:
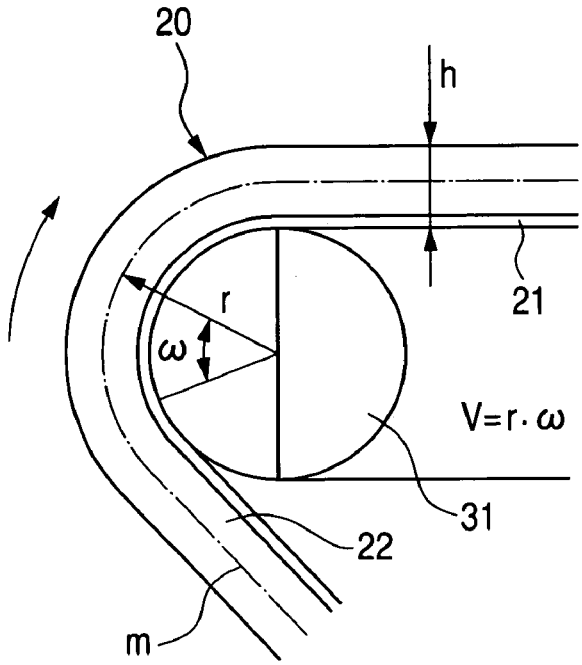
FIG. 3 is an enlarged schematic view of the vicinity of a driving roller for explaining the speed variation of an intermediate transfer belt.

In FIG. 3, the intermediate transfer belt 20 is run by the driving roller 31. However, the speed (surface movement speed) V of the intermediate transfer belt 20 at the primary transfer portions (first to fourth image forming positions) T1Y, T1M, T1C and T1K of the image forming stations PY, PM, PC and PK is decided by a driving neutral line m decided by the driving roller 31 and intermediate transfer belt 20. The speed V is shown by the following expression when assuming the turning radius of the driving neutral line m as r and the rotational angular speed as ω.

$$V=r\cdot\omega$$

Therefore, when assuming that the driving roller 31 rotates at an equal angular speed and when the driving neutral line m fluctuates, the variation appears as speed variation.

Figure 4A:
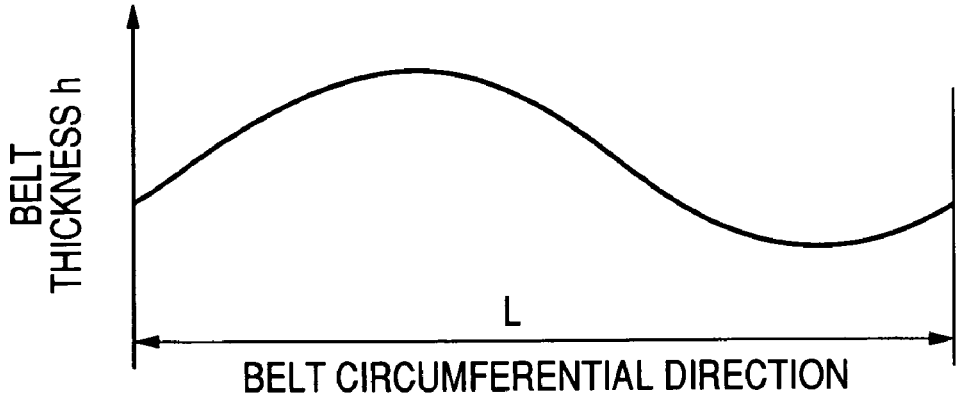
FIG. 4A is a schematic view showing a profile of thickness unevenness of an intermediate transfer belt.

In this case, for example, a belt member manufactured in accordance with the centrifugal molding method or a method including a rolling step normally has thickness unevenness by one period in the circumferential direction as described above. The thickness profile of the belt member is shown in FIG. 4A. FIG. 4A shows the variation of the thickness h for one period of the belt member and the axis of abscissa shows position (for one period, that is, circumferential length L) on the belt member and the axis of ordinate shows thickness h of the belt member.

Figure 4B:
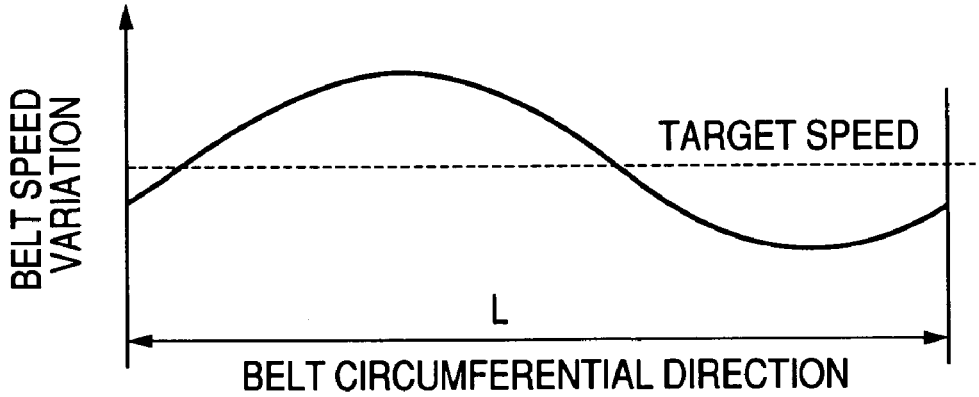
FIG. 4B is a schematic view showing a profile of speed variation.

Telescopic motion in the conveying direction of a belt member on the whole image on which a transfer displacement (misregistration) due to the speed variation caused by the thickness unevenness of the belt member occurs and the displacement due to the telescopic motion may not be ignored. That is, when the speed of the belt member is increased at a transfer position, the image extends. However, when the speed of the belt member is decreased, the image contracts. In any case, a displacement in the moving direction of the belt member occurs on the whole image. The speed profile of the belt member in this case is shown in FIG. 4B. FIG. 4B shows the speed variation for one period of the belt member, in which the axis of abscissa shows outer-peripheral positions (corresponding to image forming positions T1Y, T1M, T1C and T1K) for one period of the belt member and the axis of ordinate shows speed variation of the belt member (that is, displacement from target speed of belt member).

Figure 4C:
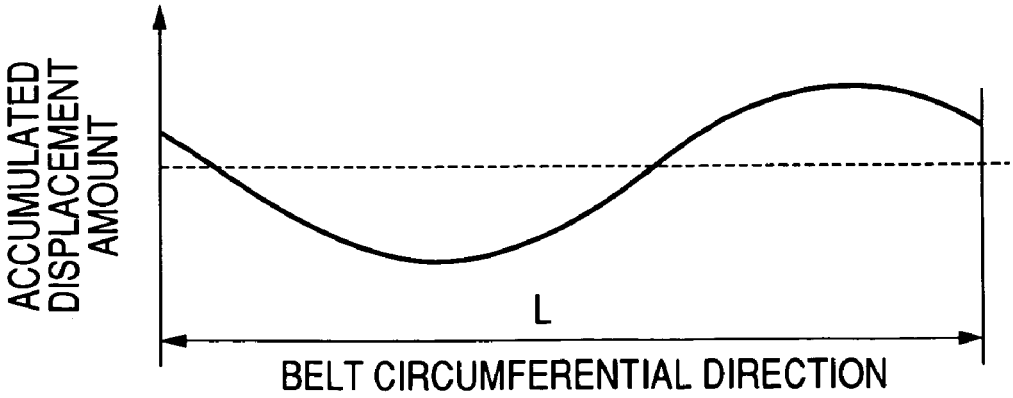
FIG. 4C is a schematic view of a profile of accumulated displacement amount.

As a result, as shown in FIG. 4C, a minute displacement for unit time is accumulated. FIG. 4C shows accumulated displacement amount at a certain position on the outer periphery of a belt member, in which the axis of abscissa shows outer peripheral position in the circumferential direction of the belt member for one period of the belt member and the axis of ordinate shows accumulated displacement amount at each position.

Figure 5:
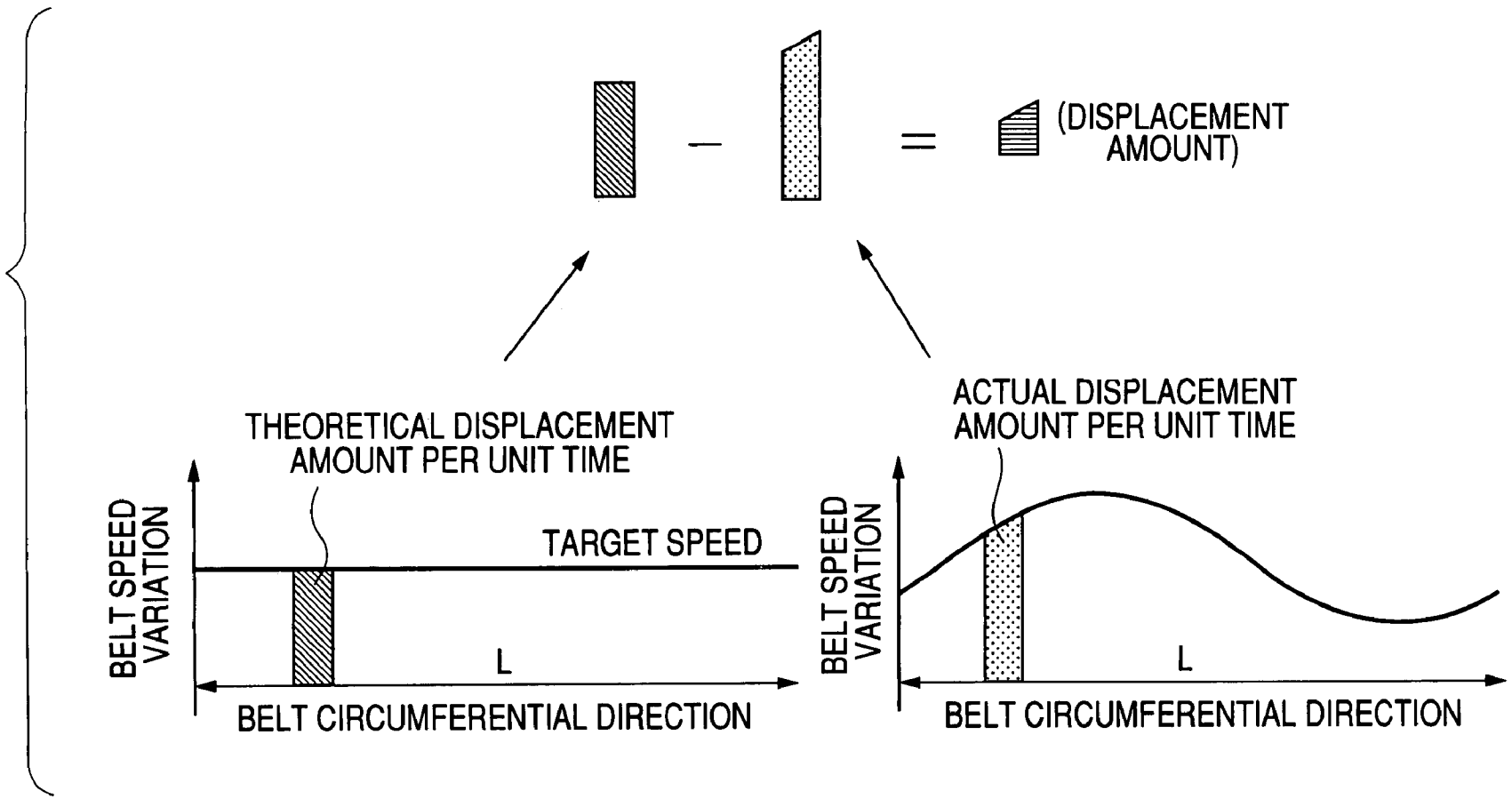
FIG. 5 is a schematic view for explaining the accumulated displacement amount of an intermediate transfer belt.

This is described below in detail by referring to FIG. 5. A displacement is shown as a difference between displacement amounts for unit time of a speed waveform having speed variation to the displacement amount for unit time of an ideal speed waveform free from speed variation. Moreover, when the difference is accumulated, the accumulated value appears as a transfer displacement.

Figure 6A:
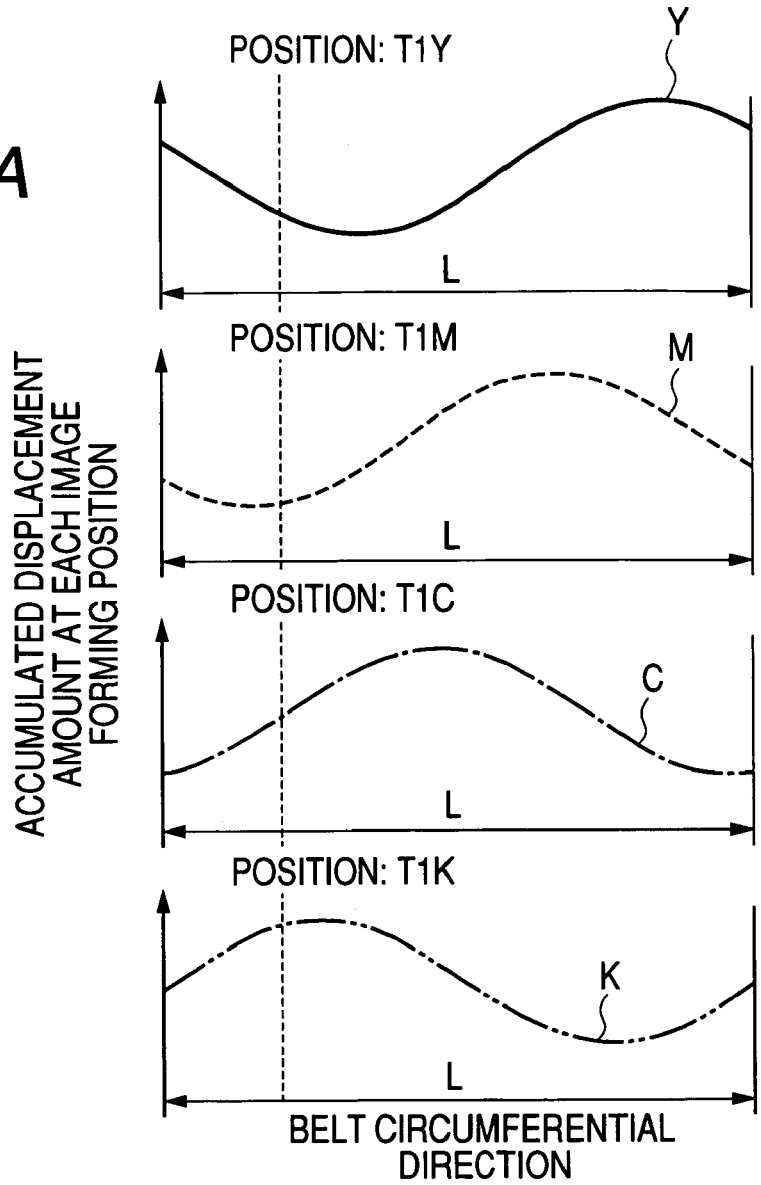
FIGS. 6A and 6B are schematic views showing transfer displacement amounts on intermediate transfer belts.
Figure 6B:
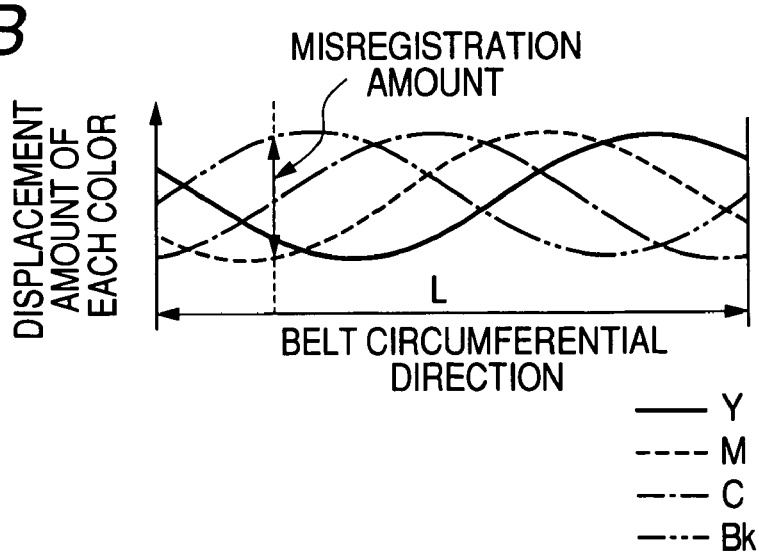

Thus, when speed variation occurs in the belt member, transfer positions of toner images at image forming positions T1Y, T1M, T1C and T1K are displaced as shown in FIG. 6B. That is, when assuming that the belt member runs at an ideal speed waveform free from speed variation and transferring images formed at the second to fourth image forming positions T1M, T1C and T1K so as to superimpose the images on the image transferred to a certain point on the belt member at the first image forming position T1Y, the images are displaced (transfer displacement, misregistration) on the belt member as shown in FIG. 6B, because of the difference of the accumulated displacement amount of the belt member when forming the image on the belt member at each image forming positions T1M, T1C and T1K as shown in FIG. 6A. Axes of abscissa in FIGS. 6A and 6B respectively show the outer peripheral position in the circumferential direction of the belt member for one period of the belt member and axes of ordinate respectively show accumulated displacement amount (transfer displacement amount of colors) at each position (second to fourth image forming positions T1M, T1C and T1K are adjusted to first image forming position T1Y on axes of abscissa for explanation).

That is, the speed of the belt member repeats fast case and slow case centering around a target speed (average speed can be also used). The speed is increased or decreased depending on the phase of the intermediate transfer belt 20 during orbit moving at a certain position of the outer periphery of belt member 20. For example, images formed tat the second, third and fourth image forming positions T1M, T1C and T1K are preceded or delayed to images formed at the reference position and the first image forming position T1Y.

This displacement is referred to as transfer displacement, which may deteriorate the image quality as on-image misregistration.

In this case, the thickness unevenness in the circumferential direction of the low-elastic resin layer 21 formed by the centrifugal molding method is not unevenness which repeats a thick state and a thin state many times in the circumferential direction but a thick state and a thin state in circumference may frequently appear like a sine wave in one circuit as described above.

However, the high-elastic rubber layer 22 is normally thicker than the low-elastic resin layer 21. According to the study by the present inventor, it is found that the thickness unevenness of the high-elastic rubber layer 22 is approximately 40 μm though the thickness unevenness of the low-elastic resin layer 21 is several microns. Moreover, when thickness unevenness occurs, the intermediate transfer belt 20 causes speed variation at the period of the thickness unevenness. Therefore, an action is requested which restrains misregistration from occurring due to the speed variation of the intermediate transfer belt 20 caused by the thickness unevenness.

Therefore, in the case of the present invention, the effective image receiving length in the circumferential direction of the intermediate transfer belt 20 is set to approximately integer multiples of the interval between image forming positions T1Y, T1M, T1C and T1K and the interval between the image forming positions T1Y, T1M, T1C and T1K is set to approximately integer multiples of the periodic interval (period) of the thickness unevenness in the circumferential direction of the intermediate transfer belt 20.

In the case of the present invention, the distance between the central position in the rotating direction of the intermediate transfer belt 20 of the primary transfer portion (first primary transfer region) in which a yellow toner image is primary-transferred to the intermediate transfer belt 20 from the photosensitive drum 1Y and the central position in the rotating direction of the intermediate transfer belt 20 of the primary transfer portion (second primary transfer region) in which a magenta toner image is primary-transferred to the intermediate transfer belt 20 from the photosensitive drum 1M is set to approximately integer multiples of the interval (period) of periodic thickness unevenness in the circumferential direction of the intermediate transfer belt 20.

In this case, the circumferential-directional effective image receiving length (effective image write length) denotes the circumferential-directional length of an image conveying member (intermediate transfer belt 20 in the case of this embodiment) capable of receiving images formed by a plurality of image forming portions. When an image conveying member is a seamless belt and an image receiving position on an image conveying member is not designated, the above effective image receiving length is normally the circumferential length of the image conveying member. When designating an image receiving range by fixing the image receiving position on an image conveying member, the above effective image receiving length becomes a length in the designated image receiving range in the circumferential direction of the image conveying member.

Moreover, the circumferential length (rotating-directional length) of the intermediate transfer belt 20 is set to approximately integer multiples of the interval (period) of periodic circumferential-directional thickness unevenness of the intermediate transfer belt 20.

The intermediate transfer belt 20 is more minutely described below by referring to FIGS. 7A to 7C, 8A and 8B. FIGS. 7A to 7C and FIGS. 8A and 8B are illustrations same as FIGS. 4A to 4C and FIGS. 6A and 6B respectively, which show the case of the intermediate transfer belt 20 of this embodiment.

Figure 7A:
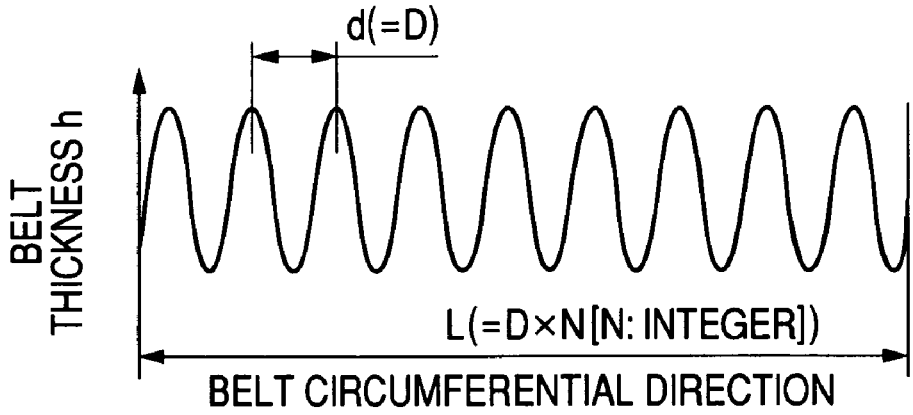
FIG. 7A is a schematic view showing a profile of the thickness unevenness of a belt member according to the present invention.

FIG. 7A shows a profile of the thickness of the intermediate transfer belt 20 when the interval (period) d between thickness unevennesses serving as speed variation components is almost equal to the interval D between the image forming positions T1Y, T1M, T1C and T1K and the total circumferential length L of the intermediate transfer belt 20 is integer multiples (9 times in this case) of the interval D between the image forming positions. That is, the intermediate transfer belt 20 has unevenness having the interval D period between the image forming positions T1Y, T1M, T1C and T1K.

Figure 7B:
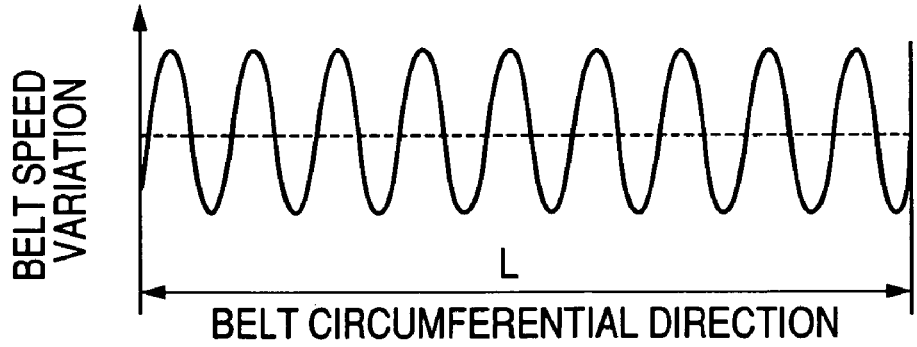
FIG. 7B is a schematic view for explaining a profile of speed variation of a belt member according to the present invention.
Figure 7C:
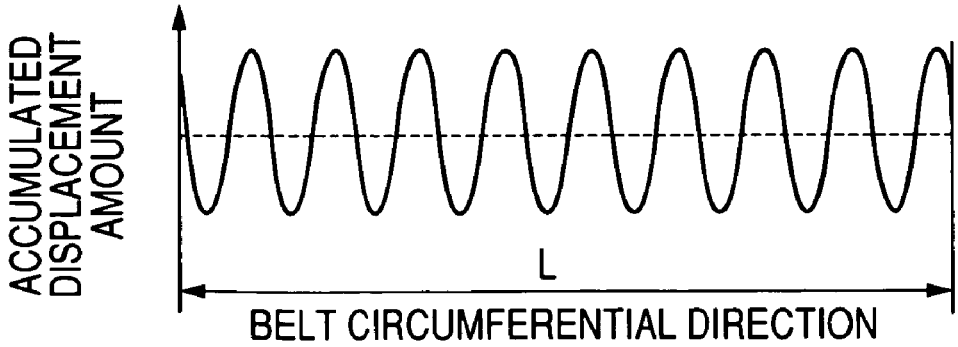
FIG. 7C is a schematic view for explaining a profile of accumulated displacement amount of a belt member according to the present invention.

When the intermediate transfer belt 20 has the thickness profile shown in FIG. 7A, the intermediate transfer belt 20 is rotation-driven by the speed variation according to the profile shown in FIG. 7B. Moreover, as shown in FIG. 7C, displacement amount accumulated at each position of the outer periphery of the intermediate transfer belt 20 varies while changing in accordance with the thickness profile (FIG. 7A) of the intermediate transfer belt 20.

Figure 8A:
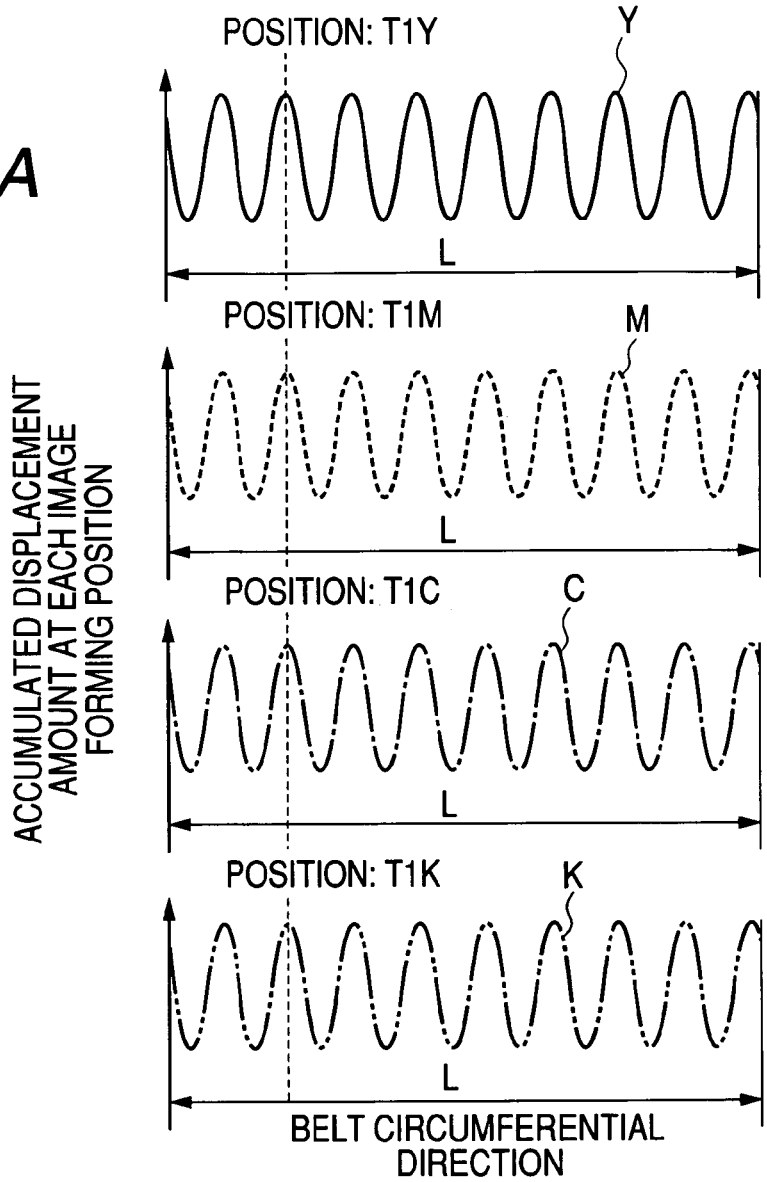
FIGS. 8A and 8B are schematic views for respectively explaining a transfer position on a belt member according to the present invention.
Figure 8B:
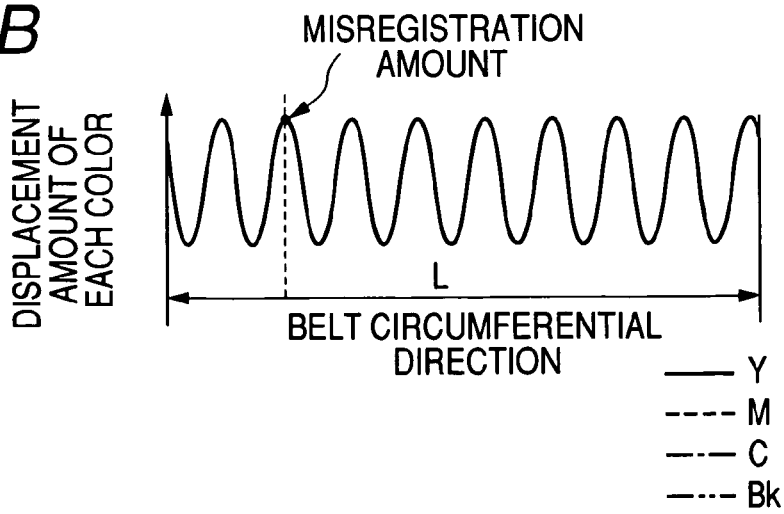

However, according to the present invention, displacement profiles at image forming positions T1Y, T1M, T1C and T1K almost coincide with each other as shown in FIG. 8A. Therefore, as shown in FIG. 8B, in the case of an image formed at a certain point on the intermediate transfer belt 20, transfer displacements at the image forming positions T1Y, T1M, T1C and T1K are canceled. That is, a transfer displacement (misregistration) substantially disappears or it is extremely decreased.

Even if the effective image receiving length of the intermediate transfer belt 20 is smaller than the total circumferential length of the intermediate transfer belt 20, profiles of thickness unevenness, speed variation and displacement within the effective image receiving length corresponding to the above circumferential length becomes the same as those shown in FIGS. 7A to 7C, 8A and 8B.

Moreover, a case is described in which the interval d between thickness unevennesses of the intermediate transfer belt 20 is almost equal to the interval D between the image forming positions T1Y, T1M, T1C and T1K in FIGS. 7A to 7C, 8A and 8B. However, the interval d is not restricted to the above case. When the interval D between the image forming positions T1Y, T1M, T1C and T1K is approximately integer multiples of the interval d between thickness unevennesses of the intermediate transfer belt 20, accumulated displacement amounts at the image forming positions T1Y, T1M, T1C and T1K at the outer periphery of the intermediate transfer belt 20 almost coincide with each other as shown in FIGS. 8A and 8B. Therefore, it is easily understood that a transfer displacement substantially disappears or is extremely decreased.

However, it is preferable that the interval between the image forming positions T1Y, T1M, T1C and T1K is normally two times or less of the interval between periodic circumferential-directional thickness unevennesses of the intermediate transfer belt 20, that is, one time to two times from the viewpoint of productivity or thickness stability at the time of rubber rolling to be described later. Moreover, from the viewpoint of the configuration or product size of an image-forming apparatus, the effective image write length in the circumferential direction of the intermediate transfer belt 20 is normally 8 to 10 times larger than that of the image forming positions T1Y, T1M, T1C and T1K.

Though not illustrated for simplification of description, fractional speed variation (speed variation due to driving roller eccentricity) of the rotating period of the driving roller 31 may be further superimposed on the speed variation amount of the belt member. It is possible to restrain the influence of misregistration due to the speed variation of the rotating period of the driving roller 31 by setting the interval between image forming positions adjacent to each other to integer multiples of the circumferential length of the driving roller 31.

That is, the interval between image forming positions adjacent to each other (central position of primary transfer region), for example, the distance between the central position in the rotating direction of the intermediate transfer belt 20 of the primary transfer portion T1Y (first primary transfer region) in which a yellow toner image is primary-transferred from the photosensitive drum 1Y to the intermediate transfer belt 20 and the central position in the rotating direction of the intermediate transfer belt 20 of the primary transfer portion T1M (second primary transfer region) in which a magenta toner image is primary-transferred from the photosensitive drum 1M to the intermediate transfer belt 20 is set to approximately integer multiples of the least common multiple of the interval (period) between the outer peripheral length of the driving roller 31 and the periodic circumferential-directional (rotating directional) thickness unevennesses of the intermediate transfer belt 20.

[Belt-member Thickness Control Method]

Then, a thickness control method of a belt member, which can be used as the intermediate transfer belt 20, is described below.

The present invention is not restricted by any theory. However, according to the study by the present inventor, it is considered that the thickness unevenness of the intermediate transfer belt 20 is caused by the following mechanism.

The intermediate transfer belt 20 of this embodiment has the low-elastic resin layer 21 and the high-elastic rubber layer 22.

The intermediate transfer belt 20 can be manufactured by the following procedure.

First, the low-elastic resin layer 21 is baked by casting a material solution in a rotating mold, which is referred to as the centrifugal molding method. A material of the low-elastic resin layer 21 can use any one of polyimide (PI), polyvinylidene fluoride (PVdF) and fiber reinforced resin. However, polyimide (PI) is preferable because it has molding stability and a high Young's modulus. This embodiment uses polyimide (PI).

Then, a high-elastic rubber layer 22 is formed on the low-elastic resin layer 21. The high-elastic rubber layer 22 can use any one of chloroprene rubber, silicone rubber, fluorinated rubber and epichlorohydrin rubber, which are elastomer materials. However, chloroprene rubber is preferable because it is superior in stability of electric resistance by carbon dispersion. This embodiment uses chloroprene rubber.

In this case, the high-elastic rubber layer 22 is formed into a sheet by rolling unvulcanized rubber (solid rubber) by calender rollers and cutting the rubber into a predetermined length. Thereafter, an integrated seamless belt member is manufactured by applying pressure and heat to the rubber layer 22 in a mold together with the low-elastic resin layer 21 and vulcanizing and molding them.

In this manufacturing process, the unvulcanized rubber is rolled by reduction rollers, which are referred to as calender rollers. Therefore, thickness unevenness occurs in the rolling direction by setting roller pressure and alignment. To vulcanize and mold the sheet-like rubber having thickness unevenness, the belt member of two-layer structure has thickness unevenness of a circumferential length period of calender rollers. Moreover, the thickness unevenness may become a large thickness unevenness compared to the case of the low-elastic resin layer 21 formed in accordance with the centrifugal molding method as previously described. When using the belt member as the intermediate transfer belt 20, the intermediate transfer belt 20 rotates while keeping the speed variation of circumferential length period of calender rollers. Therefore, misregistration due to the speed variation occurs and causes the image quality of a color image forming apparatus to deteriorate.

Therefore, the outer peripheral length of the calendar roller is set to approximately integer rate of the interval between image forming positions in an image forming apparatus in which the manufactured belt member is used as an image conveying member. Moreover, the total circumferential length of the intermediate transfer belt 20, that is, the length of the unvulcanized rubber formed like a sheet is set to approximately integer multiples of the interval between image forming positions in an image forming apparatus in which the manufactured belt member is used as an image conveying member.

Figure 9:
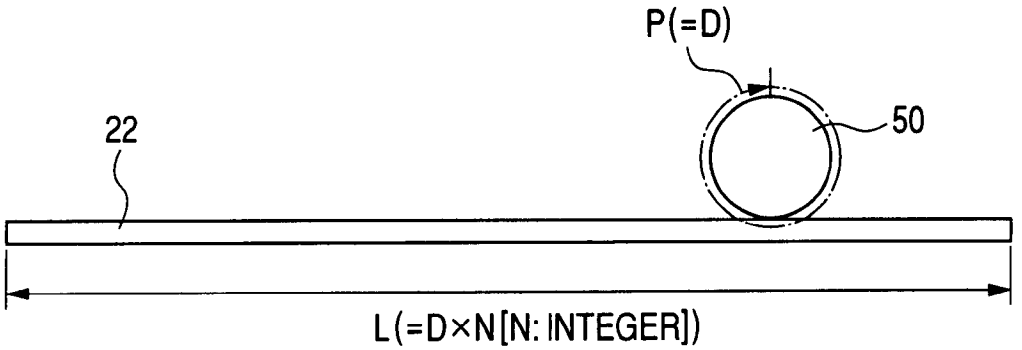
FIG. 9 is a schematic view for explaining a thickness control method of a belt member for an image forming apparatus of the present invention.

As shown in FIG. 9, in the case of this embodiment, the outer peripheral length p of a roller-shaped calender roller 50 (rolling member) is set to approximately interval D between the image forming positions T1Y, T1M, T1C and T1K in the image forming apparatus 100. Thereby, the interval (period) between thickness unevennesses of the intermediate transfer belt 20, that is, the interval between speed variations of the intermediate transfer belt 20 become almost equal to the interval D between the image forming positions T1Y, T1M, T1C and T1K and the misregistration caused by the thickness unevenness of the intermediate transfer belt 20 is canceled.

Moreover, the total circumferential length L of the intermediate transfer belt 20, that is, the length of the unvulcanized rubber formed like a sheet is set to integer multiples (9 times in this case) of the interval D between the image forming positions T1Y, T1M, T1C and T1K. Thereby, even if forming an image at any position on the intermediate transfer belt 20, it is possible to obtain an image substantially having no transfer displacement or in which the transfer displacement is extremely decreased.

However, it is preferable that the outer peripheral length p of the calender roller is set to ½ or more of the interval D between the image forming positions T1Y, T1M, T1C and T1K, that is, ½ to (1/1) from the viewpoint of productivity or thickness stability at the time of rubber rolling.

The circumferential length in the rotating direction of the intermediate transfer belt 20 used for this embodiment is 2,261 mm.

Moreover, the diameter of the calender roller 50 used in the manufacturing process is 80 mm. Therefore, the interval between periodic circumferential-directional thickness unevennesses of the intermediate transfer belt 20 of this embodiment is 251 mm.

The circumferential length in the rotating direction of the intermediate transfer belt 20, the calender roller 50 and the interval between periodic thickness unevennesses of the intermediate transfer belt 20 are not restricted to the above value.

An intermediate transfer belt having a circumferential length in the rotating direction of 500 to 5,500 mm can be sued as the intermediate transfer belt 20.

A calender roller having a diameter of 17.5 to 191 mm can be used as the calender roller 50.

Therefore, the interval between periodic circumferential-directional thickness unevennesses of the intermediate transfer belt 20 can be 55 to 600 mm.

Thus, according to this embodiment, to decrease the transfer displacement due to the thickness unevenness of the intermediate transfer belt 20 having the low-elastic resin layer 21 and high-elastic rubber layer 22, the total circumferential length L of the intermediate transfer belt 20 is set so that the interval D between the image forming positions T1Y, T1M, T1C and T1K becomes approximately integer multiples and the interval (period) between the thickness unevennesses in the circumferential direction of the intermediate transfer belt 20 becomes approximately integer multiples of the interval D between the image forming positions T1Y, T1M, T1C and T1K. In this case, as the manufacturing condition of the intermediate transfer belt 20, the outer peripheral length of the calender rollers for rolling and molding the high-elastic rubber layer 21 is set to approximately integer rate of the interval D between the image forming positions T1Y, T1M, T1C and T1K. Thereby, it is possible to prevent displacements (misregistrations) of toner images transferred to the intermediate transfer belt 20 at the image forming positions T1Y, T1M, T1C and T1K and obtain a high-quality image. Moreover, it is possible to improve the transfer characteristic. It is possible to use a belt member of a multilayer structure having the low-elastic resin layer 21 and high-elastic layer 22 as the intermediate transfer belt 20 and prevent the misregistration of the toner images formed on the intermediate transfer belt 20.

The effective image write length in the circumferential direction of the intermediate transfer belt 20 is not strictly restricted to integer multiples of the interval between the image forming positions T1Y, T1M, T1C and T1K but a belt manufactured for this purpose is also included. Similarly, the interval between the image forming positions T1Y, T1M, T1C and T1K is not strictly restricted to integer multiples of the interval between periodic circumferential-directional thickness unevennesses of the intermediate transfer belt 20 but a position manufactured for this purpose is also included. Moreover, the outer peripheral length of a reduction roller for manufacturing an elastomer elastic body is not strictly restricted to the integer rate of the interval between the image forming positions T1Y, T1M, T1C and T1K but a reduction roller manufactured for this purpose is also included.

Furthermore, the intermediate transfer belt 20 is not restricted to a belt constituted of only the low-elastic resin layer 21 and high-elastic rubber layer 22. For example, it is also allowed to apply an optional proper method such as spray coating of a fluorine coating material serving as a mold release layer to the outside (surface of the high-elastic rubber layer 22) of a vulcanized product obtained by integrating the low-elastic resin layer 21 with the high-elastic rubber layer 22.

It is also possible to use a belt constituted of one layer as the intermediate transfer belt 20.

(Other Embodiment)

As described for the above embodiment, the present invention very preferably acts when using a belt member having the sheet-like high-elastic layer 22 obtained by rolling solid rubber by calender roller and the low-elastic resin layer 21 for the intermediate transfer belt 20 serving as an image conveying member for receiving images at a plurality of image forming positions. However, the present invention is not restricted to the above conformation.

Figure 10:
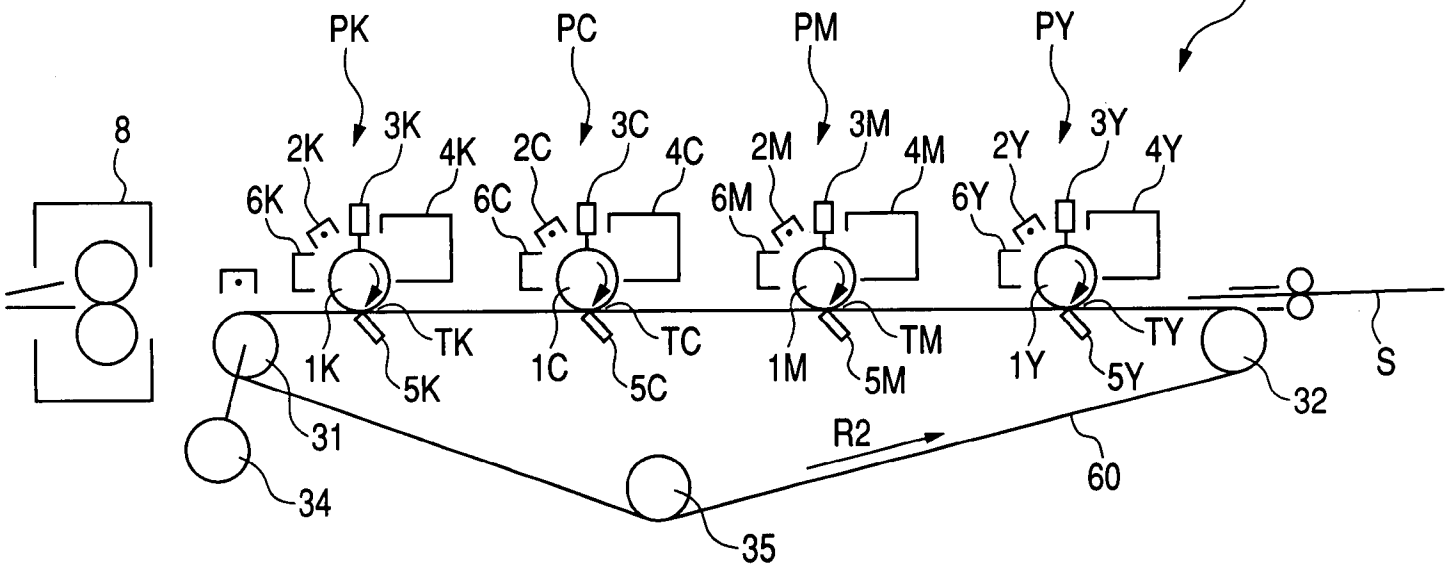
FIG. 10 is a schematic block diagram of an essential portion of an image forming apparatus for explaining another application example of the present invention.

For example, the present invention is not restricted to an image forming apparatus using an intermediate transfer belt serving as an image conveying member but it can be applied to a direct-transfer image forming apparatus for directly transferring a toner image to a recording material at a plurality of image forming positions. FIG. 10 shows a schematic view of an essential portion of this type of the image forming apparatus. In FIG. 10, a component having a function or configuration substantially same as or corresponding to that of the image forming apparatus 100 of the above embodiment is provided with the same symbol. That is, the image forming apparatus 200 has a recording-material bearing belt (recording-material bearing member) 60 for bearing and conveying a recording material as an image conveying member instead of the intermediate transfer belt 20 of the above embodiment.

The recording-material bearing belt 60 is applied to the driving roller 31, tension roller 32 and idling roller 35.

Moreover, the recording-material bearing belt 60 runs in the direction of the illustrated arrow R2 in accordance with the rotation of the driving roller 31 driven by the driving source 34.

The driving roller 31 is set so as to contact with the back of a face on which the recording material S of the recording-material bearing belt 60 is born.

The recording-material bearing belt 60 is also manufactured in accordance with the above centrifugal molding method or a method including a rolling step by a rolling member and has a periodic circumferential-directional (rotating-directional) thickness unevenness.

Moreover, similarly to the above embodiment, a yellow toner image is formed on the photosensitive drum 1Y (first image bearing member).

The yellow toner image (first toner image) is transferred to the recording material S born and conveyed by the recording-material bearing belt 60 (recording-material bearing member) in the transfer portion TY (first transfer region).

When the yellow toner image is transferred to the recording material S born and conveyed by the recording-material bearing belt 60, the recording-material bearing belt 60 contacts with the photosensitive drum 1Y through the recording material S in the transfer portion TY (first transfer region).

Moreover, while the yellow toner image is transferred to the recording material S at the first image forming station PY, a magenta toner image (second toner image) is formed on the photosensitive drum 1M (second image bearing member) similarly to the case of the above embodiment.

Then, when the recording material S to which the yellow toner image is transferred is conveyed to the recording-material bearing member 60 and moved to the transfer portion TM (second transfer region) of the second image forming station MY, the magenta toner image on the photosensitive drum 1M is transferred to a predetermined position on the recording material 60 to which the yellow toner image is transferred.

Thereafter, a cyan toner image and a black toner image are transferred onto the recording material S born and conveyed by the recording-material bearing member 60 similarly to the above case at the cyan-color transfer portion TC and the black-color transfer portion TM. Thus, superimposition of toner images of four colors on the recording material S is completed.

The recording material S on which superimposition of toner images of four colors is completed is separated from the recording-material bearing member 60 and conveyed to the heating-pressurizing-fixing system 8 which is fixing means. An unfixed toner image on the recording material S is heated and pressurized in the system 8 and thereby fixed onto the recording material S and a full-color image is obtained on the recording material S.

Toner remaining on each photosensitive drum 1 passing through a transfer step of transferring a toner image to the recording material S from the photosensitive drum 1 is removed by photosensitive cleaning means 6 having a blade contacting with the photosensitive drum 1 as a cleaning member.

Then, the photosensitive drum 1 prepares for the next latent image formation to be continuously performed.

In this case, the transfer portions TY, TM, TC and TK for transferring toner images to the recording material S from a photosensitive member 1 of the image forming stations PY, PM, PC and PK are located at a plurality of image forming positions of the circumferential direction of the recording-material bearing belt 60. Moreover, in the case of this embodiment, a photosensitive member 1, charging means 2, exposing means 3, developing member 4 and primary transferring means 5 of each image forming station P constitute image forming means which forms toner images of various colors on the recording material S on the recording-material bearing belt 60.

Also in the case of this embodiment, the distance between the central position in the rotating direction of the recording-material bearing belt 60 of the transfer portion (first transfer region) to be transferred to the recording material S in which a yellow toner image is born and conveyed by the recording-material bearing belt 60 from the photosensitive drum 1Y and the central position in the rotating direction of the recording-material bearing belt 60 of the transfer portion (second transfer region) in which a magenta toner image is born and conveyed from the photosensitive drum 1M to the recording-material bearing belt 60 is set to approximately integer multiples of the interval (period) between periodic circumferential-directional thickness unevennesses of the recording-material bearing belt 60.

Thereby, misregistration due to the thickness unevenness of the recording-material bearing belt 60 is solved.

Moreover, similarly to the case of the above embodiment, the circumferential-directional length (rotating-directional length) of the recording-material bearing belt 60 is set to approximately integer multiples of the interval (period) between periodic circumferential-directional thickness unevennesses of the recording-material bearing belt 60.

Furthermore, the interval between image forming positions (central position of transfer region) adjacent to each other, for example, the distance between the central position in the rotating direction of the recording-material bearing belt 60 of the transfer portion TY (first transfer region) to be transferred to the recording material S in which a yellow toner image is born and conveyed to the recording-material baring member 60 from the photosensitive drum 1Y and the central position in the rotating direction of the recording-material bearing belt 60 of the transfer portion TM (second transfer region) in which a magenta toner image is transferred from the photosensitive drum in to the recording-material bearing belt 60 is set to approximately integer multiples of the least common multiple of the interval (period) between the outer circumferential length of the driving roller 31 and periodic circumferential-directional (rotating directional) thickness unevennesses of the recording-material bearing belt 60.

The circumferential length of the rotating directional recording-material bearing belt 60 used for this embodiment is 2,261 mm.

Moreover, the diameter of the calender roller 50 used in the manufacturing process is 80 mm.

Therefore, the interval between periodic circumferential-directional thickness unevennesses of the recording-material bearing belt 60 of this embodiment is 251 mm.

The circumferential length in the rotating direction of the recording-material bearing belt 20, calender roller 50 and the interval between periodic thickness unevennesses of the recording-material bearing belt 60 are not restricted to the above values.

A belt having a rotating-directional circumferential length of 500 to 5,500 mm can be used as the recording-material bearing belt 60.

A calender roller having a diameter of 17.5 to 191 mm can be used as the calender roller 50.

Therefore, the interval between periodic circumferential-directional thickness unevennesses of the recording-material bearing belt 60 can be 55 to 600 mm.

Figure 11:
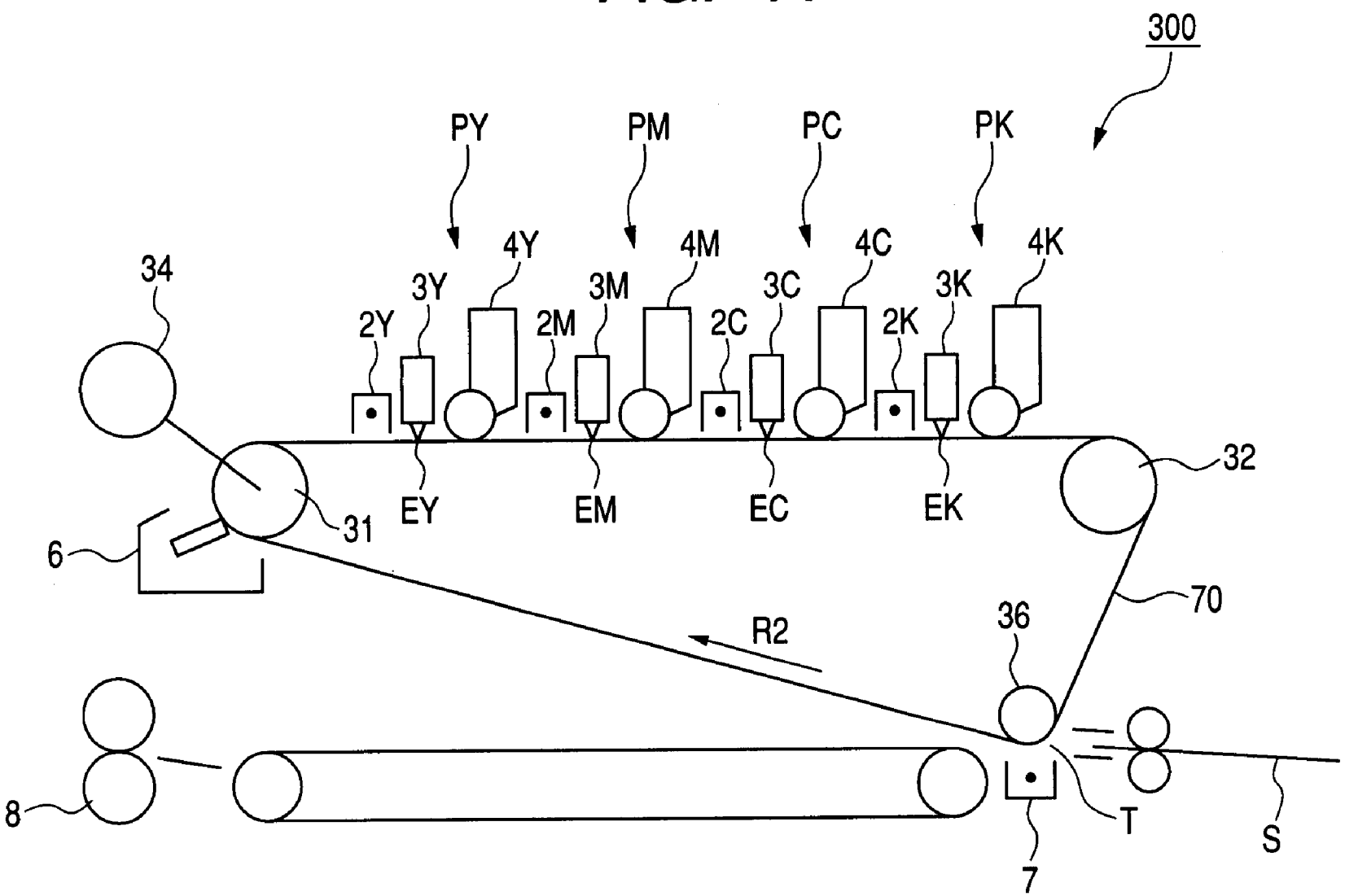
FIG. 11 is a schematic block diagram of an essential portion of an image forming apparatus for explaining still another application example of the present invention.

Moreover, the present invention can be equally applied to an image forming apparatus having a photosensitive belt (electrostatic image bearing member) 70 serving as a belt member as an image conveying member. FIG. 11 shows an example of a schematic equipment configuration of this type of the image forming apparatus. In FIG. 11, a component having a function or configuration substantially same as or corresponding to that of the image forming apparatus 100 of the above embodiment is provided with the same symbol.

The photosensitive belt 70 is applied to the driving roller 31, tension roller 32 and transfer facing roller 36.

Moreover, the photosensitive belt 60 runs in the direction of the illustrated arrow R2 in accordance with the rotation of the driving roller 31 driven by the driving source 34.

The driving roller 31 is set so as to contact with the back of a face for bearing an electrostatic image of the photosensitive belt 70.

The photosensitive belt 70 is also manufactured by the above centrifugal molding method or method including a rolling step by a rolling member and has periodic circumferential-directional (rotating directional) thickness unevenness.

That is, the image forming apparatus 300 has a photosensitive belt 70 on whose surface layer an electrophotographic photosensitive layer is formed as an image conveying member. Moreover, image forming stations for four colors obtained by using charging means (such as A COROTRON) 2 for applying uniform electric charges to the surface of the photosensitive belt 70, exposing means (such as LED array) 3 for writing an electrostatic latent image in the photosensitive belt 70 and developing means (developing machine) 4 for visualizing a latent image by toner as one set are arranged above the horizontal portion of the photosensitive belt 70 in parallel. Moreover, while the photosensitive belt (electrostatic image bearing member) 70 is rotated in the direction of the illustrated arrow R2, toner images of various colors are sequentially superimposed on the surface of the belt 70.

The photosensitive belt 70 (electrostatic image bearing member) charged by the charging means 2Y is scanned and exposed by the exposing means 3Y (first electrostatic image forming means) and an electrostatic image (first electrostatic image) is formed in accordance with the information on the yellow component of a manuscript image.

The electrostatic image according to the information on the yellow component of the manuscript image is formed in an exposing region EY (first forming region) in which the exposing means 3Y exposes the photosensitive belt 70.

The electrostatic image of the yellow component is developed by a yellow developing machine (first developing means) for performing development by yellow toner and a yellow toner image (first toner image) is formed.

Then, the photosensitive belt 70 in which the electrostatic image of the yellow component is developed is charged by the charging means 2M again. Then, the belt 70 is scanned and exposed by the exposing means 3M (second electrostatic image forming means) and an electrostatic image (second electrostatic image) according to the information on the magenta component of the manuscript image is formed.

The electrostatic image according to the information on the magenta component of the manuscript image is formed in an exposing region EM (second forming region) in which exposing means 3M exposes the photosensitive belt 70.

The electrostatic image of the magenta component is developed by a magenta developing machine (second developing means) for performing development by magenta toner and a magenta toner image (second toner image) is formed.

A cyan toner image of cyan color and a black toner image of black color are formed in the exposing regions EC and EM similarly to the above mentioned. Toner images of four colors are formed on the photosensitive belt 70.

Moreover, toner images of various colors superimposed on the photosensitive belt 70 are simultaneously transferred onto the recording material S in a transfer portion T.

The recording material S to which toner images of four colors are transferred is conveyed to the heating-pressurizing-fixing system 8 serving as fixing means. An unfixed toner image on the recording material S is heated and pressurized in the system 8 and thereby fixed on the recording material S and a full-color image is obtained on the recording material S.

The toner remaining on the photosensitive belt 70 passing through a transfer step of transferring a toner image to the recording material S from the photosensitive belt 70 is removed by the photosensitive cleaning means 6 having a blade contacting with the photosensitive belt 70 as a cleaning member.

In this case, transfer of a toner image from the photosensitive belt 70 to the recording material S is performed in the transfer portion T.

Then, the photosensitive belt 70 prepares for the next latent image formation to be continuously performed.

In this case, positions for forming latent images on the photosensitive belt 70 by the exposing means at the image forming stations PY, PM, PC and PK in the circumferential direction of the photosensitive belt 70 show a plurality of image forming positions. Moreover, in the case of this embodiment, the charging means 2, exposing means 3 and developing means 4 of each image forming station P constitute image forming means which forms toner images of various colors on the photosensitive belt 70.

Also in the case of this embodiment, the exposing means 3Y sets the distance between the central position in the rotating direction of the photosensitive belt 70 in the exposing region EY (first forming region) in which the exposing means 3Y exposes the photosensitive belt 70 and forms an electrostatic image in accordance with the information on the yellow component of a manuscript image and the central position in the rotating direction of the photosensitive belt 70 in the exposing region EM (second forming region) in which the exposing means 3M exposes the photosensitive belt 70 and forming an electrostatic image in accordance with the information on the magenta component of the manuscript image to approximately integer multiples of the interval (period) between periodic circumferential-directional thickness unevennesses of the photosensitive belt 70.

Thereby, misregistration due to the thickness unevenness of the photosensitive belt 70 is solved.

Moreover, similarly to the case of the above embodiment, the circumferential-directional length (rotating-directional length) of the photosensitive belt 70 is set to approximately integer multiples of the interval (period) between periodic circumferential-directional thickness unevennesses of the photosensitive belt 70.

Furthermore, similarly to the case of the above embodiment, the interval between exposing regions adjacent to each other, for example, the distance between the central position in the rotating direction of the photosensitive belt 70 in the exposing region EY (first region) in which the exposing means 3Y exposes the photosensitive belt 70 and forms an electrostatic image in accordance with the information on the yellow component of a manuscript image and the central position in the rotating direction of the photosensitive belt 70 in the exposing region EM (second region) in which the exposing means 3M exposes the photosensitive belt 70 and forms an electrostatic image in accordance with the information on the magenta component of the manuscript image is set to approximately integer multiples of the least common multiple of the interval (period) between the outer peripheral length of the driving roller 31 and the periodic circumferential-directional (rotating-directional) thickness unevenness of the recording-material bearing belt 60.

The circumferential length in the rotating direction of the electrostatic image bearing belt 70 used for this embodiment is 1,130 mm.

Moreover, the diameter of the calender roller 50 used in the manufacturing process is 40 mm.

Therefore, the interval between periodic circumferential-directional thickness unevennesses of the electrostatic image bearing belt 70 of this embodiment is 126 mm.

However, the circumferential length in the rotating direction of the electrostatic image bearing belt 70, calender roller 50 and interval between periodic thickness unevennesses of the electrostatic image bearing belt 70 are not restricted to the above values.

A belt having a rotating-directional length of 500 to 5,500 mm can be used as the electrostatic image bearing belt 70.

A calender roller having a diameter of 17.5 to 191 mm can be used as the calender roller 50.

Therefore, the interval between periodic circumferential-directional thickness unevennesses of the electrostatic image bearing belt 70 can range between 55 and 600 mm.

Moreover, in the case of an electrostatic-recording-type image forming apparatus (not illustrated), a latent image is formed by an ion head for directly applying electric charges to a dielectric belt in each image forming station on the dielectric belt for going around a plurality of image forming stations and developed. Thereby, it is possible to form toner images made of a plurality of types of toners (such as toners of four colors of yellow, magenta, cyan and black) on the dielectric belt. In this case, positions for forming latent images on the dielectric belt by the ion head on a plurality of image forming stations show a plurality of image forming positions in the circumferential direction of the dielectric belt. Moreover, in this case, the ion head and developing means of each image forming station P constitute image forming means, which forms toner images of various colors on the dielectric belt.

When using the recording-material bearing member 60, photosensitive belt 70 and dielectric belt used for other conformation of these image forming apparatuses or a belt member having the low-elastic resin layer 21 and high-elastic rubber layer 22 described for the above embodiment as some layers of them, thickness unevenness also occurs in the circumferential-length period of a calender roller and displacement (misregistration) of an image may occur due to the speed unevenness caused by the thickness unevenness. Therefore, by applying the present invention similarly to the case of the intermediate transfer belt 20, it is possible to substantially eliminate or extremely decrease the displacement (misregistration) of an image.

Moreover, as being understood from the above mentioned, the present invention very preferably acts when at least one layer of a belt member is manufactured by passing through a step of rolling the layer by reduction rollers.

However, the present invention is not restricted to the above case. That is, when using a belt member having a periodic circumferential-directional thickness unevenness as a belt member for receiving images at a plurality of image forming positions and used as a conveying member for conveying them, the present invention can be equally applied. For example, when using a belt member of a single low-elastic resin layer, it can serve as effective misregistration reducing means by controlling the thickness unevenness of the belt member. It is a matter of course that the present invention is effective even for a belt member of a single elastic layer (elastic member).

This application claims priority from Japanese Patent Application No. 2004-092412 filed on Mar. 26, 2004, which is hereby incorporated by reference herein.

What is claimed is:

1. An image forming apparatus comprising:

a first image bearing member;

first toner image forming means which forms a first toner image on the first image bearing member;

an intermediate transfer member in which a circumferential face is formed and rotates in a predetermined direction by using the center of the circumferential face as a rotating center, and the thickness is periodically changed in a predetermined interval in the predetermined rotating direction;

a first primary transfer region in which the first toner image on the first image bearing member is transferred to the intermediate transfer member;

a second image bearing member; second toner image forming means which forms a second toner image on the second image bearing member; and a second primary transfer region in which the toner image on the second image bearing member is transferred to the intermediate transfer member to which the first toner image is transferred, wherein the distance between the central position of the first primary transfer region in the rotating direction of the intermediate transfer member and the central position of the second primary transfer region is approximately integer multiples of the predetermined interval.

2. An image forming apparatus according to claim 1, wherein the length of the intermediate transfer member in the predetermined rotating direction is approximately integer multiples of the predetermined interval.

3. An image forming apparatus according to claim 2, wherein the intermediate transfer member is a belt.

4. An image forming apparatus according to claim 3, further comprising:

a driving roller for rotating the intermediate transfer member by contacting with the back of a face to which the toner image of the intermediate transfer member is transferred and thereby rotating, wherein the distance between the central position of the first primary transfer region and the central position of the second primary transfer region in the rotating direction of the intermediate transfer member is approximately integer multiples of the least common multiple between the predetermined interval and the circumferential length in the rotating direction of the driving roller.

5. An image forming apparatus according to any one of claims 1 to 4, wherein the predetermined interval ranges between 55 and 600 mm.

6. An image forming apparatus according to claim 5, wherein the intermediate transfer member is manufactured in accordance with a manufacturing method, which includes a step of being rolled by a roller-shaped rolling member.

7. An image forming apparatus comprising:

a first image bearing member;

first toner image forming means which forms a first toner image on the first image bearing member;

a recording-material bearing member in which a circumferential face is formed, the circumferential face rotates in a predetermined direction by using the center of the circumferential face as a rotating center and the thickness is periodically changed at a predetermined interval in the predetermined rotating direction to bear and convey a recording material;

a first transfer region in which the first toner image on the first image bearing member is transferred to the recording material to be born and conveyed by the recording-material bearing member;

a second image bearing member; second toner image forming means which forms a second toner image on the second image bearing member; and a second transfer region in which the toner image on the second image bearing member is transferred to the recording material to be born and conveyed by the recording-material bearing member to which the first toner image is transferred; wherein the distance between the central position of the first transfer region and the central position of the second transfer region in the rotating direction of the recording-material bearing member is approximately integer multiples of the predetermined interval.

8. An image forming apparatus according to claim 7, wherein the length of the recording-material bearing member in the predetermined rotating direction is approximately integer multiples of the predetermined interval.

9. An image forming apparatus according to claim 8, wherein the recording-material bearing member is a belt.

10. An image forming apparatus according to claim 9, further comprising:

a driving roller which rotates the recording-material bearing member by contacting with the back of a face for bearing the recording material of the recording-material bearing member and thereby rotating, wherein the distance between the central position of the first transfer region and the central position of the second transfer region in the rotating direction of the recording-material bearing member is approximately integer multiples of the least common multiple between the predetermined interval and the outer peripheral length in the rotating direction of the driving roller.

11. An image forming apparatus according to any one of claims 7 to 10, wherein the predetermined interval ranges between 55 and 600 mm.

12. An image forming apparatus according to claim

11, wherein the recording-material bearing member is manufactured by a manufacturing method, including a step of being rolled by a roller-shaped rolling member.

13. An image forming apparatus comprising:

an electrostatic image bearing member in which a circumferential face is formed, the circumferential face rotates in a predetermined direction by using the center of the circumferential face as a rotating center and the thickness is periodically changed at a predetermined interval in the predetermined rotating direction;

first electrostatic image forming means which forms a first electrostatic image on the electrostatic image bearing member in a first forming region; and second electrostatic image forming means which forms a second electrostatic image on the electrostatic image bearing member in a second forming region, wherein the distance between the central position of the first forming region and the central position of the second forming region in the rotating direction of the electrostatic image bearing member is approximately integer multiples of the predetermined interval.

14. An image forming apparatus according to claim 13, wherein the length of the electrostatic image bearing member in a predetermined rotating direction is approximately integer multiples of the predetermined interval.

15. An image forming apparatus according to claim 14, wherein the electrostatic image bearing member is a belt.

16. An image forming apparatus according to claim 15, further comprising:

a driving roller which rotates the electrostatic image bearing member by contacting with the back of a face on which the electrostatic image of the electrostatic image bearing member is formed and thereby rotating, wherein the distance between the central position of the first region and the central position of the second region in the rotating direction of the electrostatic image bearing member is approximately integer multiples of the least common multiple between the predetermined interval and the circumferential length in the rotating direction of the driving roller.

17. An image forming apparatus according to any one of claims 13 to 16, wherein the predetermined interval ranges between 55 and 600 mm.

18. An image forming apparatus according to claim 17, wherein the electrostatic image bearing member is manufactured in accordance with a manufacturing method, including a step of being rolled by a roller-shaped rolling member.

* * * * *

UNITED STATES PATENT AND TRADEMARK OFFICE

CERTIFICATE OF CORRECTION

PATENT NO. : 7,221,894 B2
APPLICATION NO. : 11/081553
DATED : May 22, 2007
INVENTOR(S) : Takehiro Kishi It is certified that error appears in the above-identified patent and that said Letters Patent is hereby corrected as shown below:

ON THE TITLE PAGE:

At Item (75), INVENTOR, "Takehiro Kishi, Tokyo (JP)" should read --Takehiro Kishi, Toride-shi (JP)--.

COLUMN 1:

Line 23, "born" should read --borne--.
Line 42, "born" should read --borne--.
Line 54, "born" should read --borne--.

COLUMN 2:

Line 22, "born" should read --borne--;
Line 41, "a-predetermined" should read --a predetermined--; and
Line 49, "image the" should read --image on the--.

COLUMN 4:

Line 4, "along" should read --along with--.

COLUMN 5:

Line 62, "the-intermediate" should read --the intermediate--.

COLUMN 6:

Line 15, "materials" should read --material--; and
Line 55, "after" should read --after being--.

COLUMN 7:

Line 19, "belt 6" should read --belt 20--; and
Line 20, "belt 6" should read --belt 20--.

COLUMN 8:

Line 39, "each" should read --each of the--;
Line 54, "tat the" should read --at--.

UNITED STATES PATENT AND TRADEMARK OFFICE

CERTIFICATE OF CORRECTION

PATENT NO. : 7,221,894 B2
APPLICATION NO. : 11/081553
DATED : May 22, 2007
INVENTOR(S) : Takehiro Kishi It is certified that error appears in the above-identified patent and that said Letters Patent is hereby corrected as shown below:

COLUMN 12:

Line 3, “calendar” should read--calender--;
Line 21, “become” should read --becomes--;
Line 38, “($^1/_1$)” should read --$^1/_1$--; and
Line 55, “sued” should read --used--.

COLUMN 13:

Line 8, “layer 21” should read --layer 22--.

COLUMN 14:

Line 14, “born.” should read --borne.--;
Line 24, “born” should read --borne--;
Line 28, “born” should read --borne--;
Line 42, “station MY,” should read --station PM--;
Line 47, “born” should read --borne--; and
Line 50, “portion TM.” should read --portion TK--.

COLUMN 15:

Line 19, “born” should read --borne--;
Line 24, “born” should read --borne--;
Line 43, “born” should read --borne--;
Line 44, “baring” should read --bearing--; and
Line 64, “belt 20,” should read --belt 60,--.

COLUMN 17:

Line 11, “EM” should read --EK--.

COLUMN 18:

Line 16, “recording-material bearing belt 60.” should read --electrostatic image bearing belt 70.--; and Line 41, “image forming stations and developed.” should read --image forming stations. And the latent image is developed by toners.--.

UNITED STATES PATENT AND TRADEMARK OFFICE

CERTIFICATE OF CORRECTION

PATENT NO. : 7,221,894 B2
APPLICATION NO. : 11/081553
DATED : May 22, 2007
INVENTOR(S) : Takehiro Kishi It is certified that error appears in the above-identified patent and that said Letters Patent is hereby corrected as shown below:

COLUMN 20:

Line 18, "born" should read --borne--; and
Line 25, "born" should read --borne--.

Signed and Sealed this

Seventeenth Day of June, 2008

JON W. DUDAS
*Director of the United States Patent and Trademark Office*